US009382801B2

(12) United States Patent
Cassidy et al.

(10) Patent No.: US 9,382,801 B2
(45) Date of Patent: Jul. 5, 2016

(54) METHOD FOR REMOVING A ROTOR BUCKET FROM A TURBOMACHINE ROTOR WHEEL

(71) Applicant: General Electric Company, Schenectady, NY (US)

(72) Inventors: Paul James Cassidy, Altamont, NY (US); Engelbert John Paauwe, Forney, TX (US); Michael James Tessier, Schenectady, NY (US)

(73) Assignee: General Electric Company, Schenectady, NY (US)

( * ) Notice: Subject to any disclaimer, the term of this patent is extended or adjusted under 35 U.S.C. 154(b) by 253 days.

(21) Appl. No.: 14/190,759

(22) Filed: Feb. 26, 2014

(65) Prior Publication Data

US 2015/0240642 A1 Aug. 27, 2015

(51) Int. Cl.

| | |
|---|---|
| ***F01D 5/32*** | (2006.01) |
| ***F01D 5/00*** | (2006.01) |
| ***F01D 5/30*** | (2006.01) |
| ***F01D 25/28*** | (2006.01) |

(52) U.S. Cl.

CPC ..... *F01D 5/005* (2013.01); *F01D 5/3038* (2013.01); *F01D 5/32* (2013.01); *F01D 25/285* (2013.01); *F05D 2230/68* (2013.01); *Y10T 29/49318* (2015.01)

(58) Field of Classification Search

CPC ..... F05D 2230/70; F05D 2230/72; F05D 2230/80; B23P 6/045; B23P 6/002; B23P 6/005; F01D 5/005; F01D 5/303; F01D 5/3038; F01D 5/32; F01D 25/285; Y10T 29/49318; Y10T 29/49321

See application file for complete search history.

(56) References Cited

U.S. PATENT DOCUMENTS

| | | | |
|---|---|---|---|
| 721,241 | A | 2/1903 | Russell |
| 768,597 | A | 8/1904 | Geisenhoner |
| 1,048,158 | A | 12/1912 | Herrick |
| 1,502,904 | A | 7/1924 | Campbell |
| 1,619,133 | A | 3/1927 | Kasley |
| 1,659,516 | A | 2/1928 | Compton |
| 2,032,812 | A | 3/1936 | Quattrin et al. |
| 2,047,501 | A | 7/1936 | Wettstein |
| 2,330,967 | A | 10/1943 | Griffin et al. |
| 2,453,623 | A | 11/1948 | Gilbert et al. |
| 2,593,714 | A | 4/1952 | Robinson |

(Continued)

FOREIGN PATENT DOCUMENTS

| | | | |
|---|---|---|---|
| EP | 0165735 | A2 | 12/1985 |
| WO | 2006007545 | A2 | 1/2006 |

(Continued)

OTHER PUBLICATIONS

European Search Report and Opinion issued in connection with corresponding EP Application No. 15156150.3 on Jul. 13, 2015.

*Primary Examiner* — Christopher Besler

(74) *Attorney, Agent, or Firm* — Ernest G. Cusick; Hoffman Warnick LLC

(57) ABSTRACT

A method of removing a bucket from a turbomachine rotor wheel includes exposing a base portion of the bucket, positioning a pulling device radially outwardly of the base portion, connecting the base portion of the bucket to the pulling device through a linking rod, exerting an axially outwardly directed force on the linking rod through the pulling device, and removing the base portion from the rotor wheel.

18 Claims, 9 Drawing Sheets

(56) References Cited

U.S. PATENT DOCUMENTS 2,790,620 A 4/1957 Rankin
3,042,368 A 7/1962 Cook
3,199,836 A 8/1965 Moyer
3,624,830 A 11/1971 Stehower et al.
3,673,668 A 7/1972 Crook
3,794,803 A 2/1974 Valdeck
4,078,290 A 3/1978 Fletcher et al.
4,088,421 A 5/1978 Hoeft
4,096,614 A 6/1978 Brungard et al.
4,118,136 A 10/1978 Corsmeier et al.
4,136,516 A 1/1979 Corsmeier
4,142,831 A 3/1979 Dakin et al.
4,185,369 A 1/1980 Darrow et al.
4,190,398 A 2/1980 Corsmeier et al.
4,244,676 A 1/1981 Grondahl et al.
4,392,613 A 7/1983 Graff et al.
4,400,137 A * 8/1983 Miller ..... F01D 5/326 29/889.1
4,720,898 A 1/1988 Calfo et al.
4,783,204 A 11/1988 Roarty
4,820,127 A 4/1989 Cohen et al.
5,031,311 A * 7/1991 Comensoli ..... B23P 19/025 29/426.4
5,149,073 A 9/1992 Fraser
5,235,745 A 8/1993 Fraser
5,249,918 A 10/1993 Knorowski
5,295,301 A 3/1994 Knorowski
5,425,622 A 6/1995 Murray
5,470,142 A 11/1995 Sargeant et al.
5,593,273 A 1/1997 Brinkman
5,605,487 A 2/1997 Hileman et al.
5,611,669 A 3/1997 Royle
5,622,142 A 4/1997 Strieber et al.
5,713,906 A 2/1998 Grothues-Spork et al.
5,740,668 A 4/1998 Fujiwara et al.
5,850,810 A 12/1998 Strieber et al.
5,961,286 A 10/1999 Schaub et al.
6,049,979 A 4/2000 Nolan et al.
6,065,344 A 5/2000 Nolan et al.
6,115,917 A 9/2000 Nolan et al.
6,125,819 A 10/2000 Strieber et al.
6,128,820 A 10/2000 Nolan et al.
6,168,382 B1 1/2001 Nolan et al.
6,375,423 B1 4/2002 Roberts et al.
6,477,773 B1 11/2002 Wilson et al.
6,494,683 B1 12/2002 Nolan et al.
6,499,945 B1 12/2002 Lathrop
6,571,471 B2 6/2003 Hohmann
6,702,925 B2 3/2004 Bricco et al.
6,759,627 B2 7/2004 Kilburn
6,763,560 B2 7/2004 McGee et al.
6,884,507 B2 4/2005 Lin et al.
7,066,470 B2 6/2006 Turnquist et al.
7,093,645 B2 8/2006 Grunstra et al.
7,101,462 B2 9/2006 Bricco et al.
7,134,842 B2 11/2006 Tam et al.
7,169,262 B2 1/2007 Bricco et al.
7,234,506 B2 6/2007 Grunstra et al.
7,278,460 B2 10/2007 Grunstra et al.
7,455,505 B2 11/2008 Hartmann et al.
7,513,738 B2 4/2009 Itzel et al.
7,537,809 B2 5/2009 Ochiai et al.
7,918,460 B2 4/2011 Ochiai et al.
7,950,297 B2 5/2011 Moore et al.
8,061,132 B2 11/2011 Fong et al.
8,062,098 B2 11/2011 Duescher
8,065,874 B2 11/2011 Fong et al.
8,105,032 B2 1/2012 Bracken et al.
8,117,727 B2 2/2012 McCarvill
8,157,531 B2 4/2012 Krutzfeldt et al.
8,167,566 B2 5/2012 Howes
8,191,360 B2 6/2012 Fong et al.
8,191,361 B2 6/2012 Fong et al.
8,196,395 B2 6/2012 Fong et al.
8,201,402 B2 6/2012 Fong et al.
8,215,105 B2 7/2012 Fong et al.
8,240,142 B2 8/2012 Fong et al.
8,251,659 B2 8/2012 Tisenchek et al.
8,323,302 B2 12/2012 Robertson et al.
8,387,374 B2 3/2013 Fong et al.
8,393,148 B2 3/2013 Fong et al.
8,425,194 B2 4/2013 Liotta et al.
8,436,489 B2 5/2013 Stahlkopf et al.
8,437,010 B2 5/2013 Bostanjoglo et al.
8,450,884 B2 5/2013 Stahlkopf et al.
8,468,814 B2 6/2013 Fong et al.
8,469,981 B2 6/2013 Robertson et al.
8,479,969 B2 7/2013 Shelton, IV
8,482,152 B1 7/2013 Stahlkopf et al.
8,511,976 B2 8/2013 Cummins et al.
8,516,809 B2 8/2013 Fong et al.
8,522,552 B2 9/2013 Waterstripe et al.
8,531,064 B2 9/2013 Robertson et al.
8,555,473 B2 10/2013 Howes et al.
8,561,399 B2 10/2013 Fong et al.
8,573,461 B2 11/2013 Shelton, IV et al.
2002/0079076 A1 6/2002 Bricco et al.
2003/0049130 A1 3/2003 Miller
2004/0074883 A1 4/2004 Kilburn
2004/0100035 A1 5/2004 Turnquist et al.
2004/0107554 A1 6/2004 McGee et al.
2004/0140077 A1 7/2004 Bricco et al.
2004/0149415 A1 8/2004 Bricco et al.
2004/0198852 A1 10/2004 Lin et al.
2004/0258192 A1 12/2004 Angeliu et al.
2005/0035096 A1 2/2005 Kilburn
2005/0049621 A1 3/2005 Feingold et al.
2005/0120715 A1 6/2005 Labrador
2005/0220622 A1 10/2005 Korzun et al.
2005/0224474 A1 10/2005 Kilburn
2006/0039790 A1* 2/2006 Hartmann ..... B23P 6/002 416/220 R
2006/0130994 A1 6/2006 Grunstra et al.
2006/0140768 A1 6/2006 Tam et al.
2006/0201651 A1 9/2006 Grunstra et al.
2006/0213274 A1 9/2006 Moore et al.
2007/0068644 A1 3/2007 Bricco et al.
2007/0163745 A1 7/2007 Grunstra et al.
2007/0189896 A1 8/2007 Itzel et al.
2008/0155985 A1 7/2008 Labrador
2008/0298970 A1 12/2008 Ferber et al.
2009/0022592 A1 1/2009 Liotta et al.
2009/0053959 A1 2/2009 Datta et al.
2009/0077802 A1 3/2009 Moroso et al.
2009/0081032 A1 3/2009 Moroso et al.
2009/0126493 A1 5/2009 Moore et al.
2009/0138015 A1 5/2009 Conner et al.
2009/0138084 A1 5/2009 Conner et al.
2009/0149959 A1 6/2009 Conner et al.
2009/0171461 A1 7/2009 Conner et al.
2009/0196735 A1 8/2009 Bracken et al.
2009/0200748 A1 8/2009 Ochiai et al.
2009/0220345 A1 9/2009 Krutzfeldt et al.
2009/0265908 A1* 10/2009 Corn ..... F01D 25/285 29/426.1
2009/0270989 A1 10/2009 Conner et al.
2009/0297701 A1 12/2009 Jabado et al.
2010/0003904 A1 1/2010 Duescher
2010/0092280 A1 4/2010 Draper
2010/0124490 A1 5/2010 Ochiai et al.
2010/0129230 A1 5/2010 Tisenchek et al.
2010/0162546 A1 7/2010 Kalmar et al.
2010/0212316 A1 8/2010 Waterstripe et al.
2010/0239409 A1 9/2010 Draper
2010/0326075 A1 12/2010 Fong et al.
2010/0329903 A1 12/2010 Fong et al.
2011/0023488 A1 2/2011 Fong et al.
2011/0023977 A1 2/2011 Fong et al.
2011/0030359 A1 2/2011 Fong et al.
2011/0030552 A1 2/2011 Fong et al.
2011/0036091 A1 2/2011 Waterstripe et al.
2011/0094698 A1 4/2011 Grunstra
2011/0097205 A1 4/2011 Maddaus
2011/0115223 A1 5/2011 Stahlkopf et al.

(56) References Cited

U.S. PATENT DOCUMENTS

| | | | |
|---|---|---|---|
| 2011/0158819 | A1 | 6/2011 | Mani et al. |
| 2011/0162179 | A1 | 7/2011 | Howes et al. |
| 2011/0196286 | A1 | 8/2011 | Robertson et al. |
| 2011/0196287 | A1 | 8/2011 | Robertson et al. |
| 2011/0196398 | A1 | 8/2011 | Robertson et al. |
| 2011/0196399 | A1 | 8/2011 | Robertson et al. |
| 2011/0196400 | A1 | 8/2011 | Robertson et al. |
| 2011/0288573 | A1 | 11/2011 | Yates et al. |
| 2011/0290851 | A1 | 12/2011 | Shelton, IV |
| 2011/0295269 | A1 | 12/2011 | Swensgard et al. |
| 2011/0295270 | A1 | 12/2011 | Giordano et al. |
| 2011/0314800 | A1 | 12/2011 | Fong et al. |
| 2012/0019009 | A1 | 1/2012 | Fong et al. |
| 2012/0027584 | A1 | 2/2012 | Cummins et al. |
| 2012/0067036 | A1 | 3/2012 | Fong et al. |
| 2012/0082550 | A1 | 4/2012 | Harris, Jr. et al. |
| 2012/0082565 | A1 | 4/2012 | Ellis et al. |
| 2012/0090314 | A1 | 4/2012 | Fong et al. |
| 2012/0099996 | A1 | 4/2012 | Delvaux |
| 2012/0099999 | A1 | 4/2012 | Bhokardole et al. |
| 2012/0107134 | A1 | 5/2012 | Harris, Jr. et al. |
| 2012/0118111 | A1 | 5/2012 | McCarvill |
| 2012/0119633 | A1 | 5/2012 | McCarvill |
| 2012/0138660 | A1 | 6/2012 | Shelton, IV |
| 2012/0195743 | A1 | 8/2012 | Walunj et al. |
| 2012/0199631 | A1 | 8/2012 | Shelton, IV et al. |
| 2012/0199633 | A1 | 8/2012 | Shelton, IV et al. |
| 2012/0203070 | A1 | 8/2012 | Crenshaw et al. |
| 2012/0211546 | A1 | 8/2012 | Shelton, IV |
| 2012/0248070 | A1 | 10/2012 | Chen et al. |
| 2012/0255292 | A1 | 10/2012 | Fong et al. |
| 2012/0268747 | A1 | 10/2012 | Bostanjoglo et al. |
| 2012/0272496 | A1* | 11/2012 | Herbold ..... F01D 25/285 29/402.03 |
| 2012/0286522 | A1 | 11/2012 | Stahlkopf et al. |
| 2012/0291989 | A1 | 11/2012 | Fong et al. |
| 2012/0317771 | A1 | 12/2012 | Zhang et al. |
| 2013/0022471 | A1 | 1/2013 | Roberts, III et al. |
| 2013/0042474 | A1 | 2/2013 | Noe et al. |
| 2013/0047597 | A1 | 2/2013 | Fong et al. |
| 2013/0101386 | A1 | 4/2013 | Pandey et al. |
| 2013/0104533 | A1 | 5/2013 | Fong et al. |
| 2013/0108480 | A1 | 5/2013 | Fong et al. |
| 2013/0111895 | A1 | 5/2013 | Fong et al. |
| 2013/0156587 | A1 | 6/2013 | Kubel et al. |
| 2013/0160292 | A1 | 6/2013 | Davis et al. |
| 2013/0168961 | A1 | 7/2013 | Stahlkopf et al. |
| 2013/0177429 | A1 | 7/2013 | Bommanakatte et al. |
| 2013/0193189 | A1 | 8/2013 | Swensgard et al. |
| 2013/0245659 | A1 | 9/2013 | Robertson et al. |
| 2013/0268107 | A1 | 10/2013 | Bostanjoglo et al. |
| 2013/0291529 | A1 | 11/2013 | Stahlkopf et al. |

FOREIGN PATENT DOCUMENTS

| | | | |
|---|---|---|---|
| WO | 2009026207 | A1 | 2/2009 |
| WO | 2010096540 | A2 | 8/2010 |
| WO | 2012085602 | A1 | 6/2012 |

* cited by examiner

METHOD FOR REMOVING A ROTOR BUCKET FROM A TURBOMACHINE ROTOR WHEEL

BACKGROUND OF THE INVENTION

The subject matter disclosed herein relates to the art of turbomachines and, more particularly, to a method of removing a rotor bucket from a turbomachine rotor wheel.

Steam turbines typically include rotating buckets or blades and stationary nozzles. Steam is passed through a number of turbine stages. Each stage includes a row of stationary nozzles and rotating blades mounted to a rotor wheel. Steam expands through the number of turbine stages to rotate rotor wheel creating work.

The buckets are typically mounted to the rotor wheel through a dovetail attachment. The rotor wheel may include an internal, circumferential dovetail. Each bucket or blade has a corresponding dovetail that cooperates with the internal, circumferential dovetail. Generally, each rotor wheel features a loading position or gate opening configured to receive each bucket. Each bucket is mounted to the rotor wheel and manipulated into place about the outer diametric surface. Once all buckets are mounted, a closure bucket is installed in the loading portion and secured to the rotor wheel to prevent bucket liberation.

BRIEF DESCRIPTION OF THE INVENTION

According to one aspect of an exemplary embodiment, a method of removing a bucket from a turbomachine rotor wheel includes exposing a base portion of the bucket, positioning a pulling device radially outward of the base portion, connecting the base portion of the bucket to the pulling device through a linking rod, exerting a radially outwardly directed force on the linking rod through the pulling device, and removing the base portion from the rotor wheel.

According to another aspect of an exemplary embodiment, a method of removing a bucket from a rotor wheel includes positioning a ram radially outward of the base portion, connecting the base portion of the bucket to a ram, exerting a radially outwardly directed force on the base portion, and removing the base portion from the rotor wheel.

These and other advantages and features will become more apparent from the following description taken in conjunction with the drawings.

BRIEF DESCRIPTION OF DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
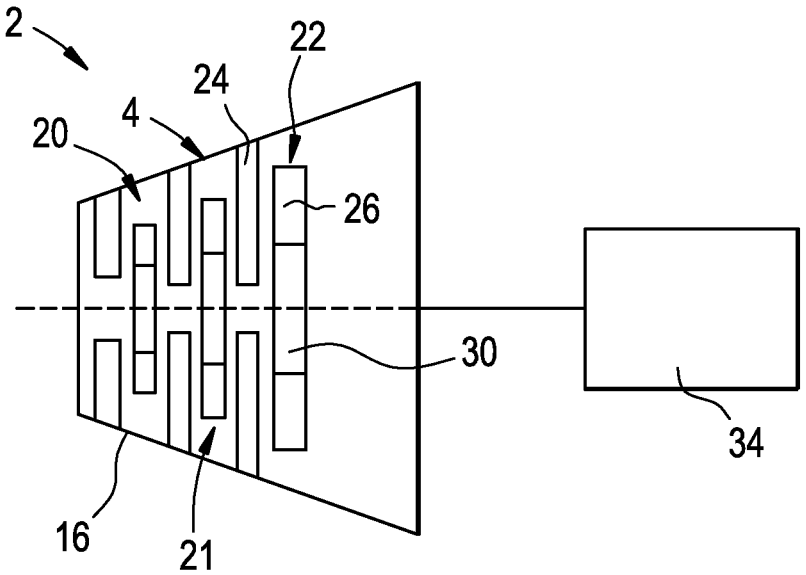
FIG. 1 PRIOR ART
FIG. 1 is schematic view of a turbomachine shown in the form of a steam turbine in accordance with the prior art

A turbomachine is illustrated generally at 2 in FIG. 1. Turbomachine 2 is shown in the form of a steam turbine 4 having a turbine housing 16 that encloses a number of turbine stages three of which are indicated at 20, 21 and 22. Of course, it would be appreciated by one of ordinary skill in the art that the number of turbine stages could vary. Each turbine stage 20-22 includes a corresponding plurality of stationary airfoil members or nozzles, such as indicated at 24 in connection with stage 22, arranged upstream from a plurality of rotating airfoil members or buckets, such as shown at 26. Rotating airfoil members 26 are mounted to a rotor wheel 30 within steam turbine 4.

With this arrangement, steam from a boiler or similar arrangement (not shown) is directed into steam turbine 4. The steam expands through stages 20-22 creating work that is used to power an external component 34. External component 34 may take on a variety of forms including a generator or a pump or other mechanically driven systems. That is, steam turbine 4 could also be used as a power source for a vehicle.

Figure 2:
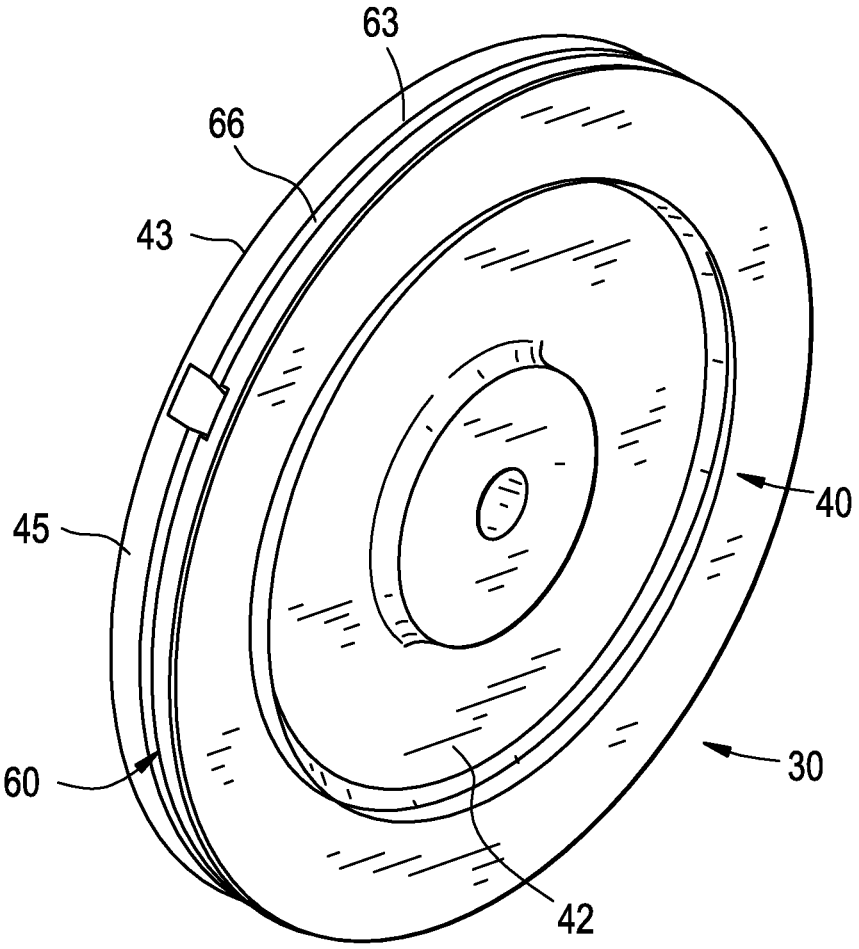
FIG. 2 PRIOR ART
FIG. 2 is a perspective view of a rotor wheel of the turbomachine of FIG. 1.
Figure 3:
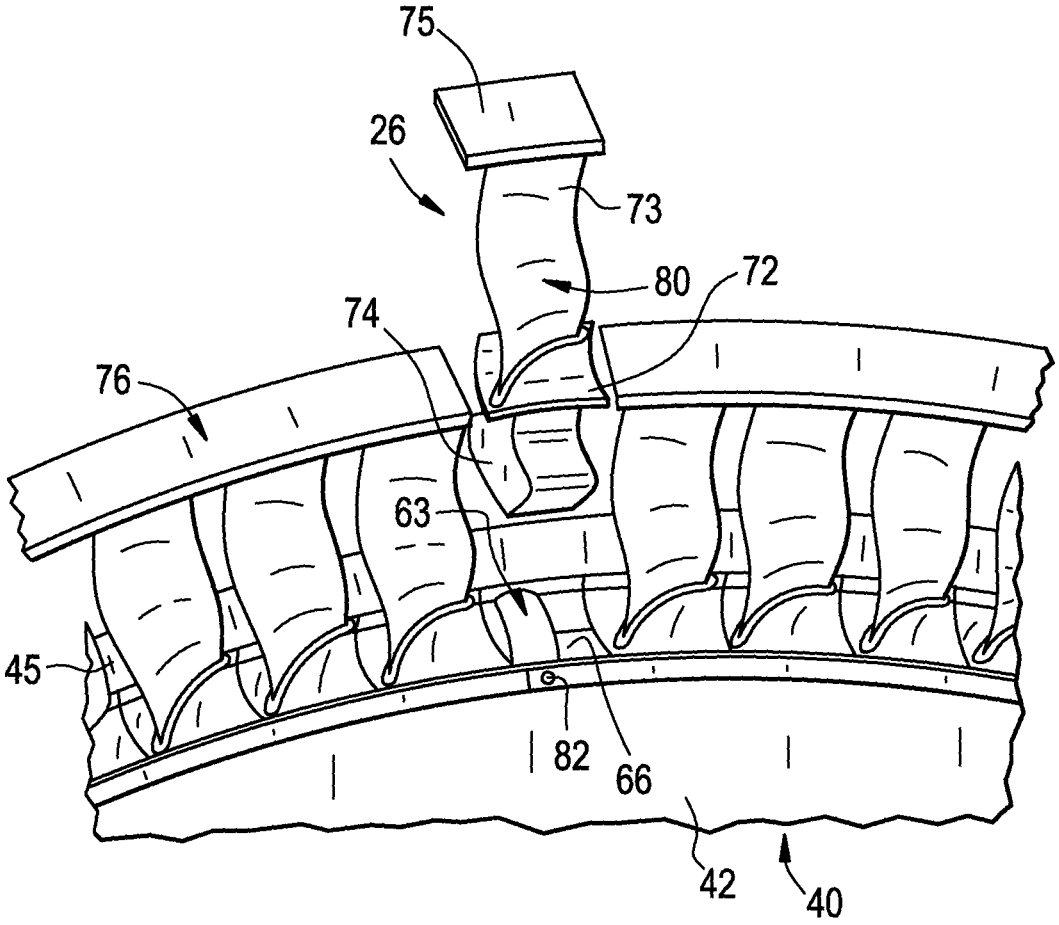
FIG. 3 PRIOR ART
FIG. 3 is a perspective view of a closure bucket spaced from the rotor wheel of FIG. 2.
Figure 4:
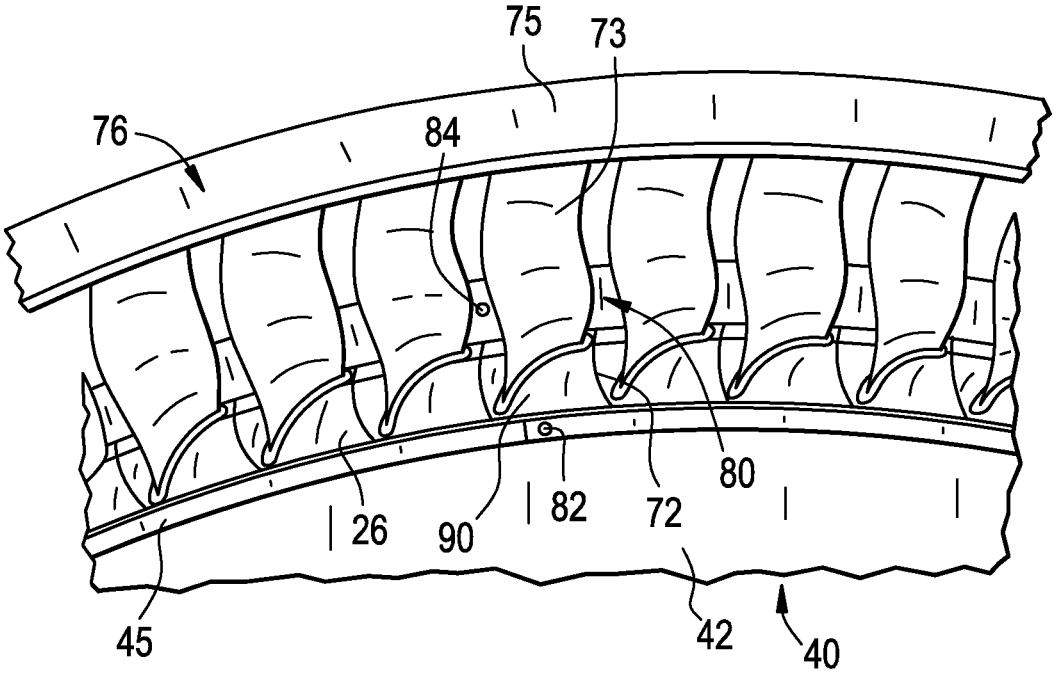
FIG. 4 PRIOR ART
FIG. 4 is a perspective view of the closure bucket of FIG. 3 installed in the rotor wheel.

In accordance with the exemplary embodiment illustrated in FIG. 2, rotor wheel 30 includes a rotor wheel body 40 having a first face 42 and an opposing, second face 43 that are joined by an outer diametric surface 45. A bucket receiving slot 60 is formed in outer diametric surface 45. Bucket receiving slot 60 supports plurality of rotating airfoil members 26 about outer diametric surface 45. Bucket receiving slot 60 includes a bucket mounting opening 63 and interior cavity 66 formed in rotor wheel body 40. Each of the plurality of rotating airfoil members 26 includes a base portion 72 (FIG. 3) that supports an airfoil portion 73 and a mounting member or dovetail 74. Airfoil portion 73 includes a ring element 75 that forms part of a circumferentially extending rotor ring 76. Dovetail 74 is shaped to nest within bucket receiving slot 60. Each of the plurality of rotating airfoil members 26 is guided into bucket receiving slot 60 and manipulated into position. Once all buckets are installed, a closure bucket 80 is installed into bucket receiving slot 60 and held in place by mechanical fasteners or grub screws 82 and 84, such as shown in FIG. 4

Figure 5:
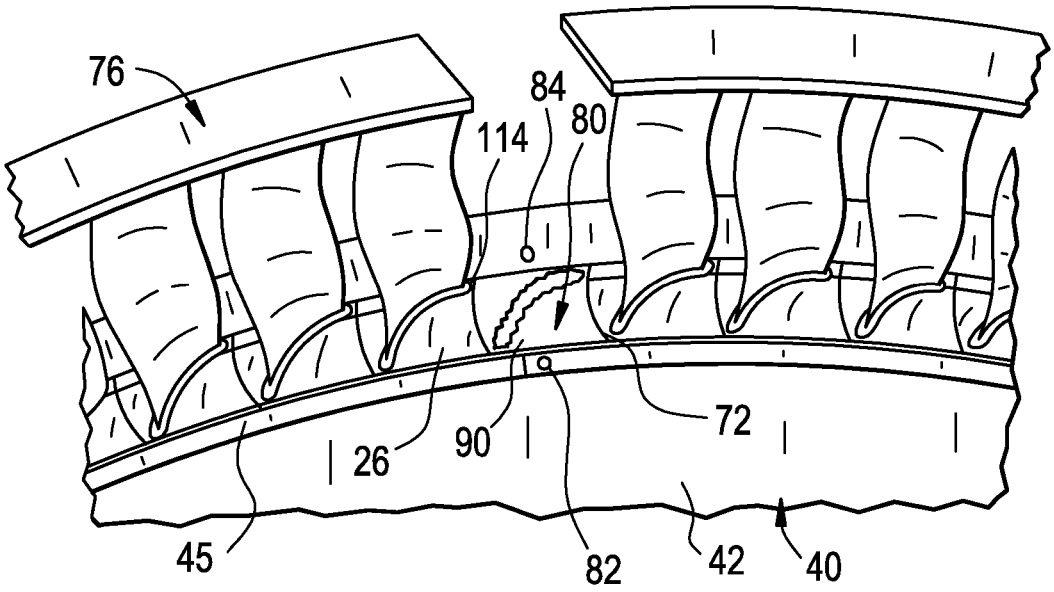
FIG. 5 is a perspective view of a bucket portion of the closure bucket removed, in accordance with an exemplary embodiment.
Figure 6:
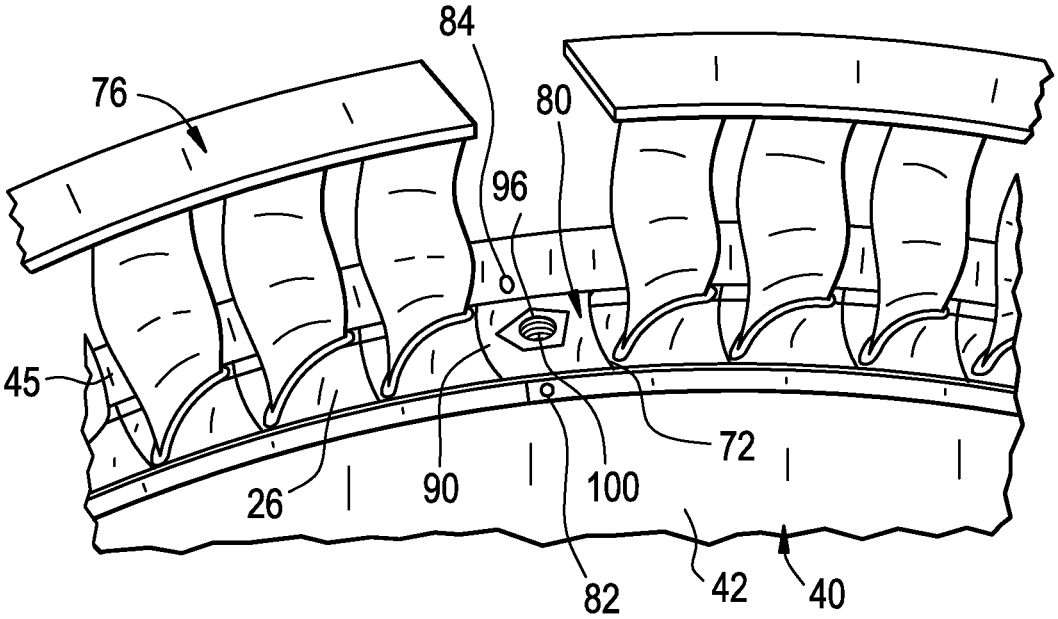
FIG. 6 is a perspective view of a threaded opening formed in a base portion of the closure bucket of FIG. 5, in accordance with an exemplary embodiment.

Over the course of time, steam turbine 4 may be taken offline for maintenance and/or repair. Maintenance includes an inspection of the buckets. During operation a bucket(s) may become damaged. The damaged bucket(s) is removed and replaced. Removing the damaged bucket first requires removal of the closure bucket 80 which may, itself, be damaged. In accordance with an aspect of an exemplary embodiment, removal of a damaged closure bucket 80 includes removing grub screws 82 and 84 and airfoil portion 73, as shown in FIG. 5, to expose an upper surface 90 of base portion 72. After removing airfoil portion 73, a bore 96 is formed in closure bucket 80, as shown in FIG. 6. Bore 96 extends radially inwardly into base portion 72. A plurality of threads 100 are formed in base portion 72 along bore 96.

Figure 7:
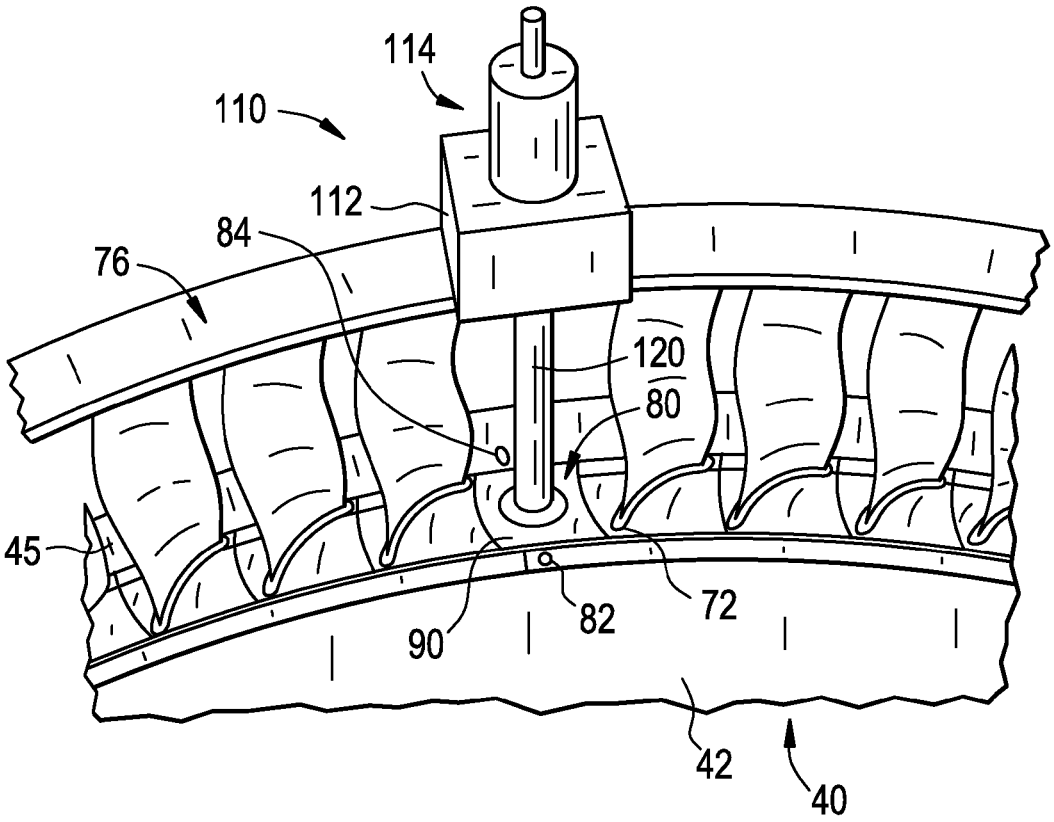
FIG. 7 is a perspective view of a pulling device coupled to the base portion of the closure bucket of FIG. 6, in accordance with an exemplary embodiment.
Figure 8:
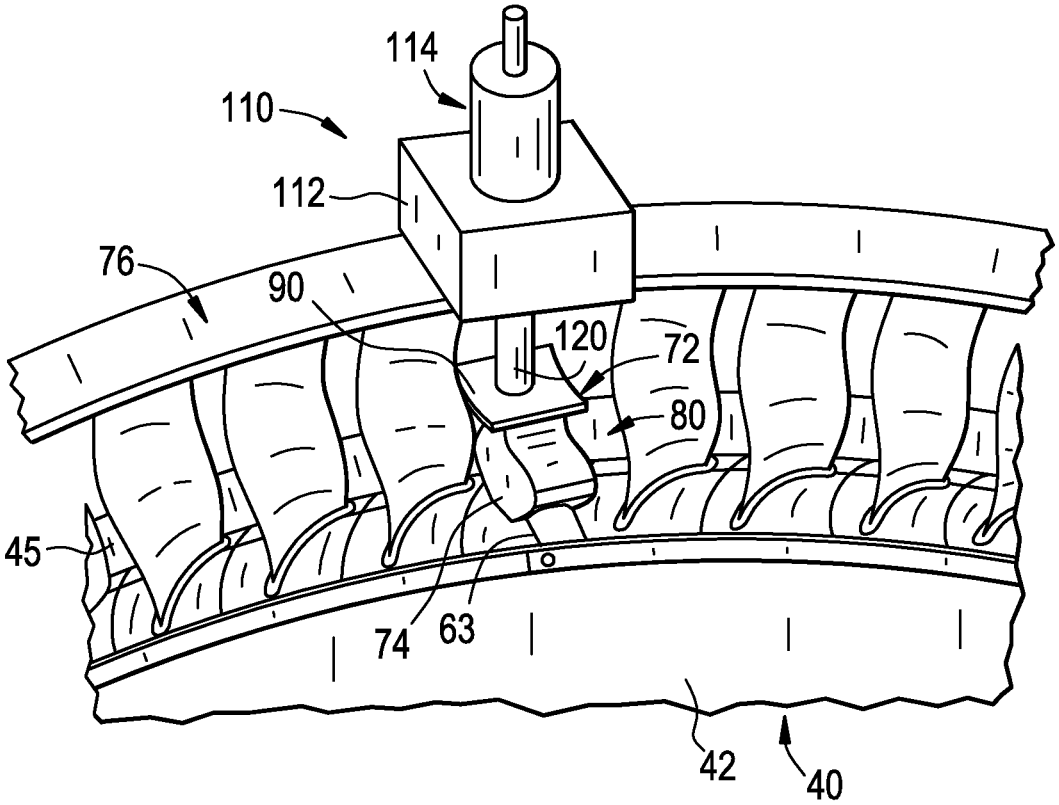
FIG. 8 is a perspective view of the base portion of the closure bucket being removed from the rotor wheel by the pulling device, in accordance with an aspect of an exemplary embodiment.

After forming threads 100, a pulling device 110 is arranged radially outward of closure bucket 80, as shown in FIG. 7. Pulling device 110 includes a base 112 supported by rotor ring 76 and a ram 114. Pulling device 110 may rely upon air pressure, hydraulic pressure, or electrical current to operate ram 114. Ram 114 is connected to base portion 72 through a linking rod 120. Linking rod 120 includes a plurality of threads (not separately labeled) that engage with threads 100 in base portion 72. Ram 114 is actuated to exert a radially outwardly directed force on base portion 72 through linking rod 120. The radially outwardly directed force may cause base portion 72 to release from rotor wheel 30, as shown in FIG. 8. At this point, the remaining buckets may be circumferentially shifted to bucket mounting opening 63 and removed from rotor wheel 30 for inspection and/or replacement.

Figure 9:
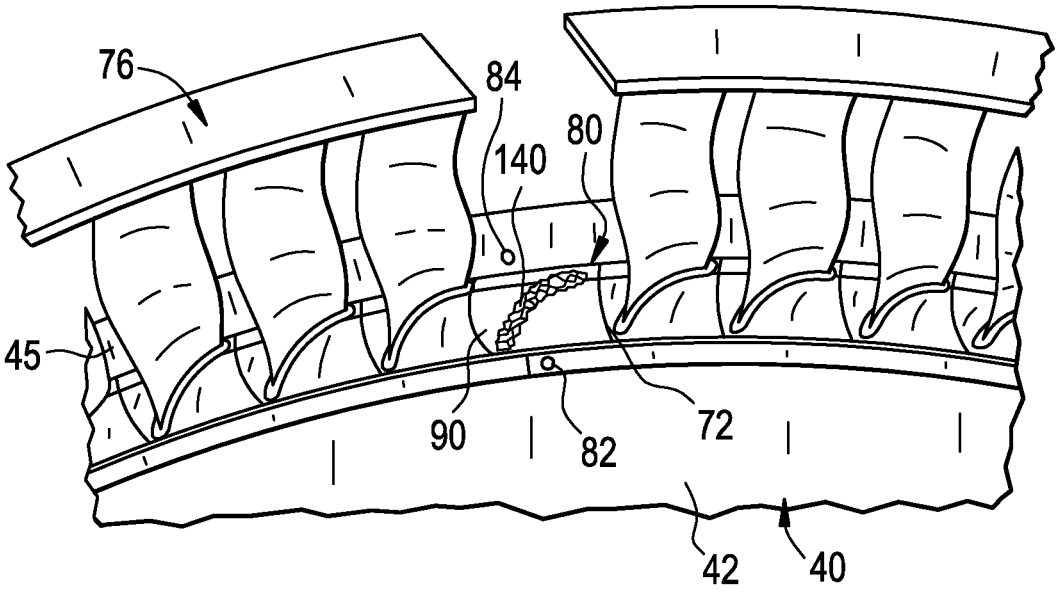
FIG. 9 is a perspective view of the base portion of the closure bucket being removed in pieces, in accordance with another aspect of an exemplary embodiment.

At this point it should be understood that the exemplary embodiments describe a method for removing a closure bucket from a rotor wheel. In the event that the closure bucket may does not release from rotor wheel, base portion and pin may be broken up into a plurality of pieces, indicated generally at 140, and removed, as shown in FIG. 9. At this point, the remaining buckets may be circumferentially shifted to bucket mounting opening 63 and removed. If the additional buckets resist removal efforts, all airfoil portions may be removed and corresponding base portions broken up into pieces 140 to enable removal. It should also be understood that while described in terms of removing a bucket from a rotor wheel in a steam turbine, the method may also be employed to remove buckets from rotor wheels arranged in other turbomachine systems including compressors and gas turbines. Further, it should be understood that the method may be used to remove the closure bucket without requiring that the rotor wheel be separated from other rotor wheels or removed from the turbine rotor. The destruction of a single bucket, in situ, reduces downtime and overall maintenance costs associated with the steam turbine 4.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. A method of removing a bucket from a turbomachine rotor wheel, the method comprising:

exposing a base portion of the bucket, wherein exposing the base portion of the bucket includes removing an airfoil portion from the base portion;

positioning a puffing device radially outwardly of the base portion;

connecting the base portion of the bucket to the pulling device through a linking rod;

exerting a force on the linking rod, the force being exerted through the pulling device, the force being directed radially outwardly of the rotor wheel, the force forcing the linking rod radially outwardly from the rotor wheel into the pulling device; and removing the base portion from the turbomachine rotor wheel.

2. The method of claim 1, wherein connecting the base portion of the bucket includes forming a bore into the base portion.

3. The method of claim 2, further comprising: forming a plurality of threads along the bore.

4. The method of claim 1, wherein positioning the pulling device includes supporting the pulling device on a rotor ring surrounding the turbomachine rotor wheel.

5. The method of claim 1, wherein positioning the pulling device includes supporting a ram radially outwardly of the base portion.

6. The method of claim 1, wherein exerting the radially outwardly directed force includes directing a hydraulic fluid into the pulling device.

7. The method of claim 1, wherein exerting the radially outwardly directed force includes operating a screw in the pulling device.

8. The method of claim 1, wherein removing the base portion further comprises:

breaking the base portion into multiple pieces; and removing each of the multiple pieces from the turbomachine rotor wheel.

9. A method of removing a bucket from a rotor wheel comprising:

exposing a base portion of the bucket, the exposing including removing an airfoil portion from the base portion;

positioning a ram radially outwardly of the bucket;

connecting a base portion of the bucket to the ram;

exerting a radially outwardly directed force on the base portion, the exerting the radially outwardly directed force on the base portion includes forcing a linking rod radially outwardly from the rotor wheel into the ram; and removing the base portion from the rotor wheel.

10. The method of claim 9, wherein connecting the base portion of the bucket includes forming a bore into the base portion.

11. The method of claim 10, further comprising: forming a plurality of threads along the bore.

12. The method of claim 11, wherein connecting the base portion to the ram includes establishing a threaded connection between the ram and the plurality of threads.

13. The method of claim 9, wherein positioning the ram includes supporting the ram on a rotor ring surrounding the rotor wheel.

14. The method of claim 9, wherein forcing the linking rod radially outwardly includes directing pressurized fluid into the ram.

15. The method of claim 14, wherein directing a pressurized fluid into the ram include urging hydraulic fluid into the ram.

16. The method of claim 9, wherein exerting the radially outwardly directed force includes directing an electrical current to the ram.

17. The method of claim 16, wherein the electrical current powers a screw.

18. The method of claim 9, wherein removing the base portion further comprises:

breaking the base portion into multiple pieces; and removing each of the multiple pieces from the rotor wheel.

* * * * *